US008215140B1

(12) United States Patent
Gaines

(10) Patent No.: US 8,215,140 B1
(45) Date of Patent: Jul. 10, 2012

(54) ENTRY LOCK

(76) Inventor: Ronald I. Gaines, Chicago, IL (US)

( * ) Notice: Subject to any disclaimer, the term of this patent is extended or adjusted under 35 U.S.C. 154(b) by 351 days.

(21) Appl. No.: 12/557,614

(22) Filed: Sep. 11, 2009

(51) Int. Cl.
*E05B 73/00* (2006.01)

(52) U.S. Cl. ..... 70/14; 70/19; 70/94; 70/465; 292/338; 292/DIG. 15

(58) Field of Classification Search ..... 70/14, 94, 70/465, 19, 58, 209; 292/338, 339, DIG. 15
See application file for complete search history.

(56) References Cited

U.S. PATENT DOCUMENTS

| | | | | |
|---|---|---|---|---|
| 5,109,322 | A | 4/1992 | Loughlin | |
| 5,850,172 | A | 12/1998 | Lenz et al. | |
| 6,727,805 | B2 | 4/2004 | Hollister et al. | |
| 7,374,213 | B2 | 5/2008 | Carlson | |
| 2005/0212682 | A1 | 9/2005 | Petriello | |
| 2006/0208920 | A1 | 9/2006 | Carrella | |
| 2006/0218977 | A1 * | 10/2006 | Witchey | 70/14 |
| 2006/0236730 | A1 * | 10/2006 | Wyers | 70/14 |
| 2006/0272365 | A1 * | 12/2006 | Copus | 70/14 |
| 2009/0056390 | A1 * | 3/2009 | Falkensson | 70/14 |

* cited by examiner

*Primary Examiner* — Suzanne Barrett
(74) *Attorney, Agent, or Firm* — Mathew R.P. Perrone, Jr.

(57) ABSTRACT

An entry lock for keeping an automatically locking or closing from closing or locking has a latch body assembly with a left arm assembly and an adjustable right arm assembly capable of being secured to opposing sides of the door while the latch body housing is locked or secured to an edge of the door. The lock is released by a standard handcuff key, carried by most law officers.

20 Claims, 7 Drawing Sheets

ENTRY LOCK

CROSS REFERENCE TO RELATED APPLICATION

This application is based, in part, on U.S. Provisional Application Ser. No. 61/096,475, filed Sep. 12, 2008, and incorporated herein by reference.

This invention relates to an entry lock and more particularly to an entry lock for use in the security industry to keep an automatically locking door open, especially to facilitate the ingress and egress of first responders through a door, which closes or locks automatically.

BACKGROUND OF THE INVENTION

Many apartment complexes, dormitories, condominiums, businesses, and other buildings have security systems installed whereby a person has to contact an attendant or security guard to gain entrance. Many times the attendant or security guard presses a release button and the door is unlocked. Once the door closes, it remains locked until the attendant or security guard releases it again. In other words, this door closes or locks automatically, whether a mechanical or an electrical means.

In an emergency situation, which requires the presence of a law enforcement officer, fire fighters, medical personnel or other first responder, these systems present great problems. The first law enforcement officer to arrive is usually allowed entry. However, due to the automatic closing or locking of the door, subsequent officers or first responders must contact the attendant or security guard to gain entrance to the building. This process requires wasted use of valuable time in an emergency situation. A device that makes entry into the building more efficient is clearly a useful invention.

Moreover, law enforcement officers use rocks, carpets, sticks, bricks or other readily available items to prop the door open for later arriving officers. However, these items are a problem in that a passerby does not realize that these items are intended to be there for safety reasons and remove the items. Thus, later arriving agents must still contact the attendant or security guard to gain access to the building. A device, which keeps the door open and that is not easily removed by unauthorized individuals, is clearly a useful invention.

Such a device must be easy to carry and use. The other requirements for this device include strength and durability. The clear conflicts of the requirements cause great difficulty in forming such a device.

Such a device can permit first responders to reach a disaster much more efficiently, due to getting there in a more timely fashion. Such efficiency inherently leads to a saving of time, and possibly lives of people the first responders are trying to help.

While it is desirable, to make such a device to be easily attachable to the door desired to remain open, and difficult to remove, there will come a time when it is desired to remove the device. At that time, it is desired to have a deliberate, controlled process for removing such a device from the door, at the appropriate time. These desirable features conflict and make such a device difficult to accomplish.

SUMMARY OF THE INVENTION

Among the many objectives of the present invention is the provision of an entry lock which can quickly and efficiently be applied to a door, in order to keep the door open.

Another objective of the present invention is the provision of an entry lock, which is hard to remove from the door.

Still another objective of the present invention is the provision of an entry lock, which is securely attachable to the door.

Yet another objective of the present invention is the provision of an entry lock, which is predictably removed from the door.

Also, an objective of the present invention is the provision of an entry lock, which can be easily carried.

Moreover, an objective of the present invention is the provision of an entry lock, which is durable.

These and other objectives of the invention (which other objectives become clear by consideration of the specification, claims and drawings as a whole) are met by providing an entry lock, having a latch body assembly with a left arm assembly and a right arm assembly capable of being secured to opposing sides of the door while the latch body housing is locked or secured to an edge of the door. The lock is released by a standard handcuff key, carried by most law officers.

BRIEF DESCRIPTION OF DRAWINGS

Throughout the figures of the drawings, where the same part appears in more than one figure of the drawings, the same number is applied thereto.

DESCRIPTION OF THE PREFERRED EMBODIMENTS

Figure 1:
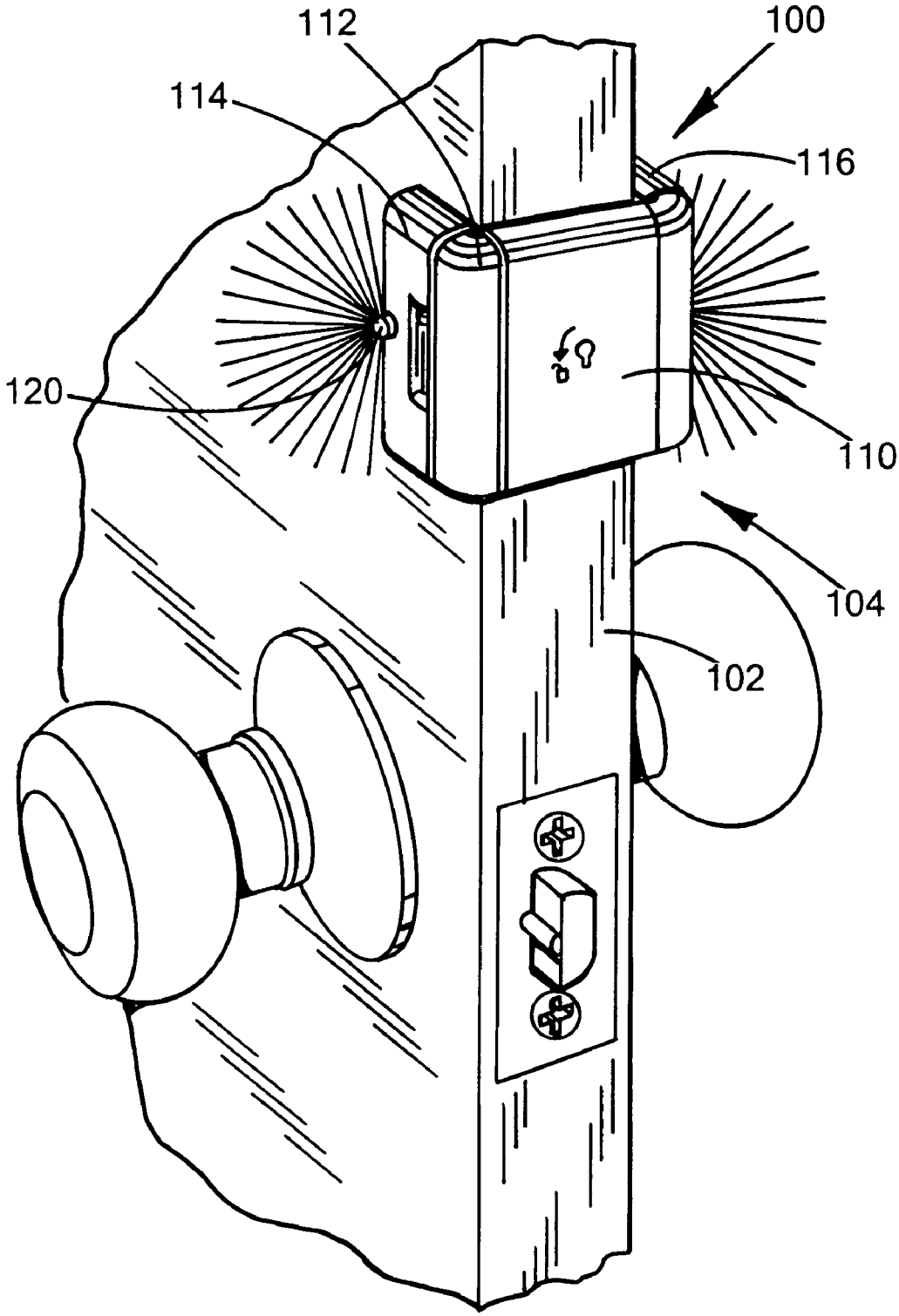
FIG. 1 depicts a perspective view of entry lock 100 of this invention in use.

Reference will now be made in detail to several embodiments of the invention that are illustrated in accompanying drawings. Whenever possible, the same or similar reference numerals are used in the drawings and the description to refer to the same or like parts or steps. The drawings are in simplified form and are not to precise scale. For purposes of convenience and clarity only, directional terms such as top, bottom, left, right, up, down, over, above, below, beneath, rear, and front, may be used with respect to the drawings. These and similar to directional term are not to be construed to limit the scope of the invention in any manner. The words attach, connect, couple, and similar terms with their inflectional morphemes do not necessarily denote direct or intermediate connections, but may also include connections through mediate elements or devices.

With the entry lock having a latch body assembly with two lockable and rotationally movable, oppositely disposed arm assemblies, one arm assembly is connected thereto by an adjustable assembly. The other arm assembly is connected to the latch body assembly with a hinge. In this manner, the entry lock is capable of being secured to opposing sides of the door while the central housing is locked or secured to an edge of the door. The lock is released by a standard handcuff key, carried by most law enforcement officers.

The latch body assembly has the left arm assembly and the right arm assembly mounted on opposing sides thereof. Both the left arm assembly and the right arm assembly are secured to the latch body assembly by a hinge. The left arm assembly is connected directly the latch body assembly with a hinge. The right arm assembly has an adjustable assembly therebetween, which permits adjusting to a door thickness. Such a hinge action facilitates use and storage of the entry lock.

Preferably each arm assembly folds flat and mutually adjacent on one side of the latch body, when the entry lock is in a closed position. The closed position makes the entry lock easier to transport or carry in a pocket. In open position the left arm assembly and the right arm assembly are extended slightly beyond a ninety-degree angle with the latch body assembly. As the latch body assembly is placed on an edge of the door, each arm assembly is pushed toward the door and into contact therewith thanks to the adjustable assembly. Each arm assembly has a friction surface, contacting opposing sides of the door, and locking thereat, thereby holding themselves and the latch body assembly on the door to keep the door from closing. Between the locking mechanism, and the friction surface, the entry lock is secured in place until the locking mechanism is released.

Release of the locking mechanism from the door is preferably accomplished by use of the standard police officer handcuff key. This locking mechanism can also secure the entry lock in the closed position if that is desired. However, the entry lock is easier to use or to apply to a door, if it is not locked in the closed position. A badge number or a name can be put on an interior of the entry lock, to permit it to be returned to the desired officer.

Referring now to FIG. 1, entry lock 100 is shown in use on door 102. Depicted here are how the four assemblies grip and hold onto the door 102 from a front view 104 of entry lock 100. Latch body assembly 110 includes adjustable assembly 112 connecting left arm assembly 114 thereto. More particularly, left arm assembly 114 is viewable as attached to adjustable assembly 112, while right arm assembly 116 is partially concealed on the other side of door 102. It is also possible to include a light means such as an LED light 120 or other light source, to assist or inform subsequent first responders about the location of the incident, among other reasons.

Figure 2:
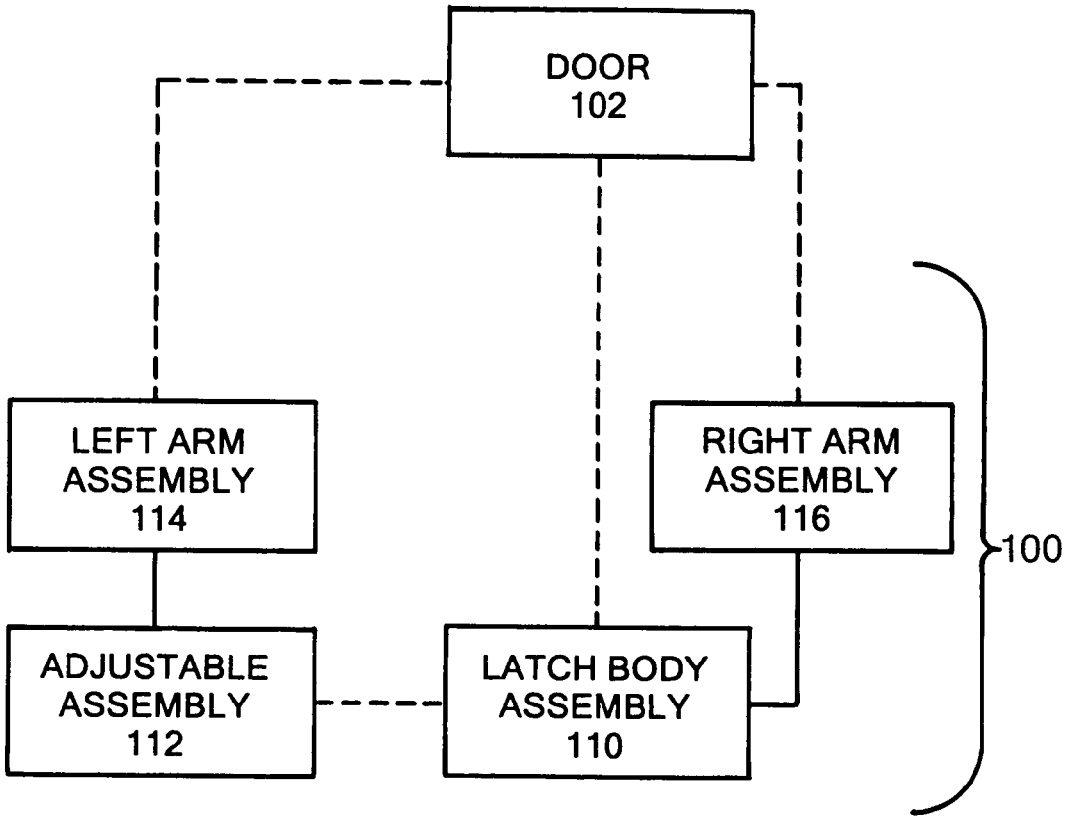
FIG. 2 depicts a box chart showing the relationship of entry lock 100 and its assemblies to door 102.

Turning now to FIG. 2, the relationship of assemblies for entry lock 100 to door 102 is depicted. More particularly, adjustable assembly 112 is connected between latch body assembly 110 and left arm assembly 114. Right arm assembly 116 is connected latch body assembly 110. Left arm assembly 114 is oppositely disposed from right arm assembly 116. When entry lock 100 is in use, left arm assembly 114 and right arm assembly 116 are positioned on opposing sides of door 102.

Figure 3:
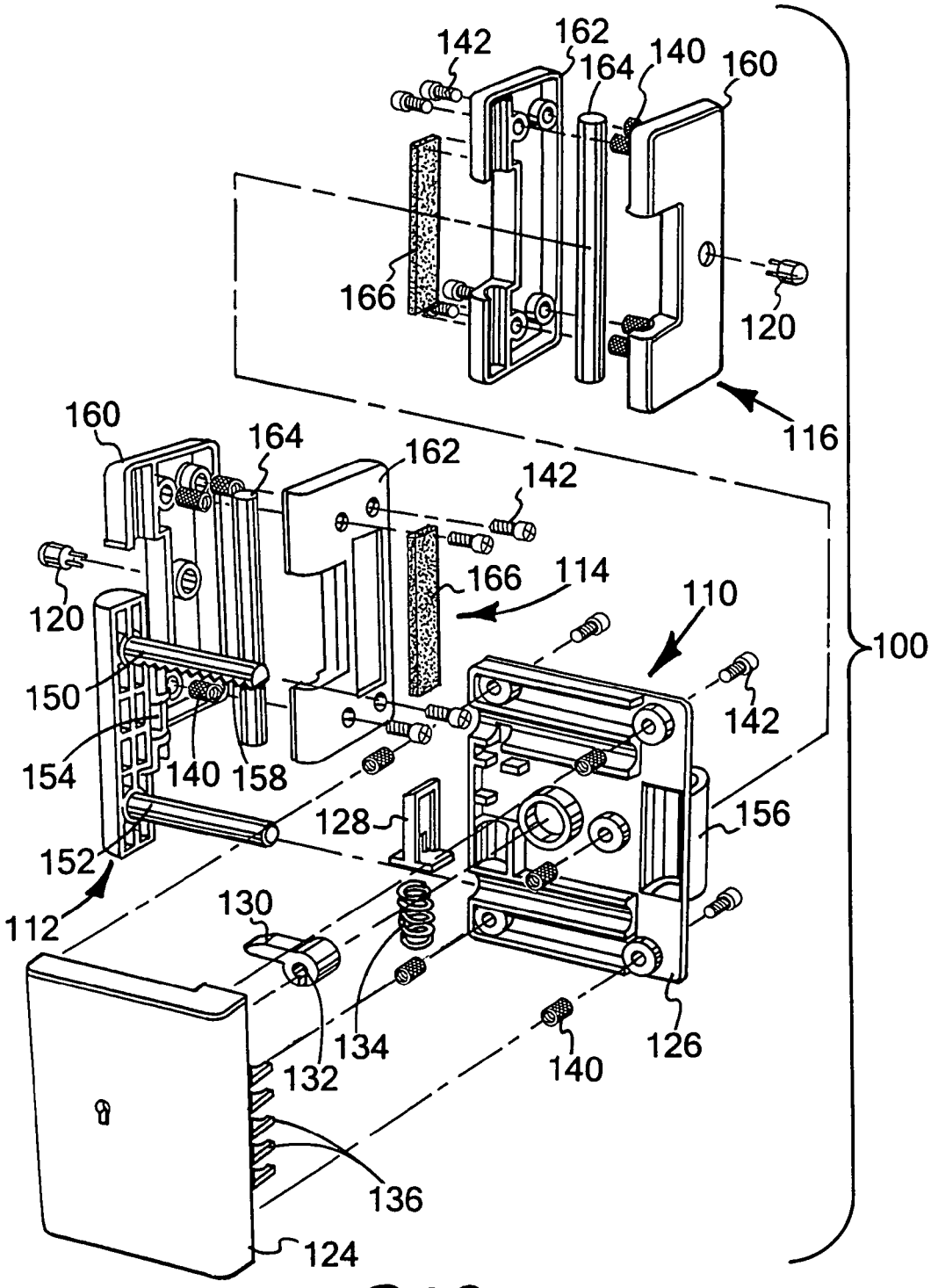
FIG. 3 depicts a perspective exploded front view 104 of the front of entry lock 100 featuring key slot 132.
Figure 4:
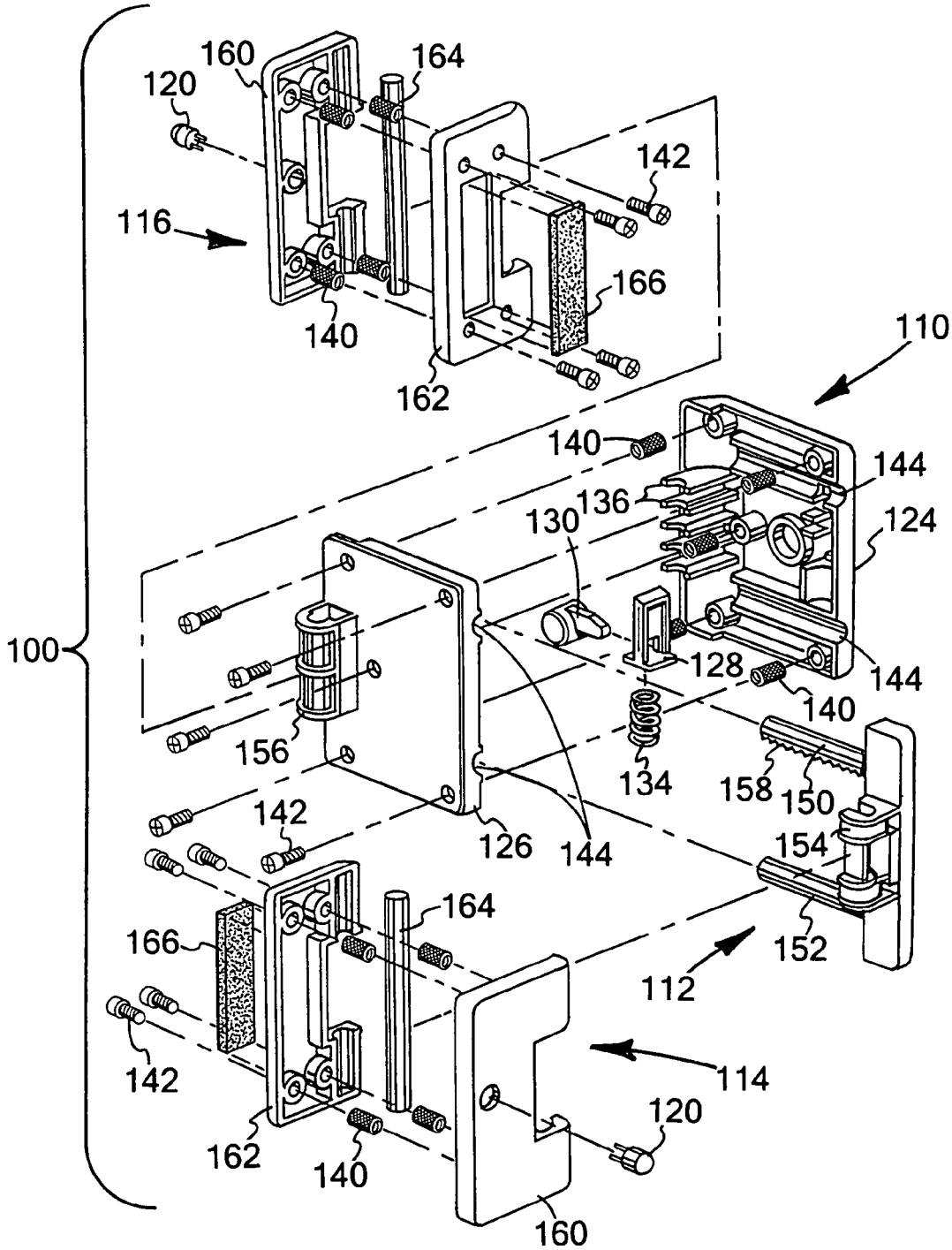
FIG. 4 depicts a perspective exploded rear view of the front of entry lock 100 and a reverse view of FIG. 3.

Adding FIG. 3 and FIG. 4 to the consideration, entry lock 100 is more clearly shown. While FIG. 3 shows key slot 132 of entry lock 100, while FIG. 4 conceals key slot 132, as a reverse view of FIG. 4. The four assemblies include the latch body assembly 110, the adjustable assembly 112, the left arm assembly 114, and the right arm assembly 116.

The latch body assembly 110 includes the front end half 124 and the back end half 126. The latch 128 is therebetween, while the release lever 130 is positioned above latch 128 to cooperate therewith. Latch spring 134 supports latch 128 and cooperates with key slot 132 (FIG. 3) to secure or use entry lock 100.

Hinge truss 136 is positioned on front end half 124 to cooperate with right hinge 156 and receive hinge pin 164, which is located on left side assembly 114. In this manner, left arm assembly 114 is supported on latch body assembly 110. A plurality of threaded inserts 140 and corresponding fastener screws 142 secure front end half 124 to back end half 126.

Adjustable assembly 112 fits into latch body assembly 110 at receivers 144. One of receivers 144 has latch rack 150 therein, while the other receives guide pin 152. Adjustable assembly 112 includes latch rack 150 with a guide pin 152 and left hinge 154 positioned therebetween. Latch rack 150 includes latch teeth 158, which facilitate adjustment of the entry lock 100

Figure 5:
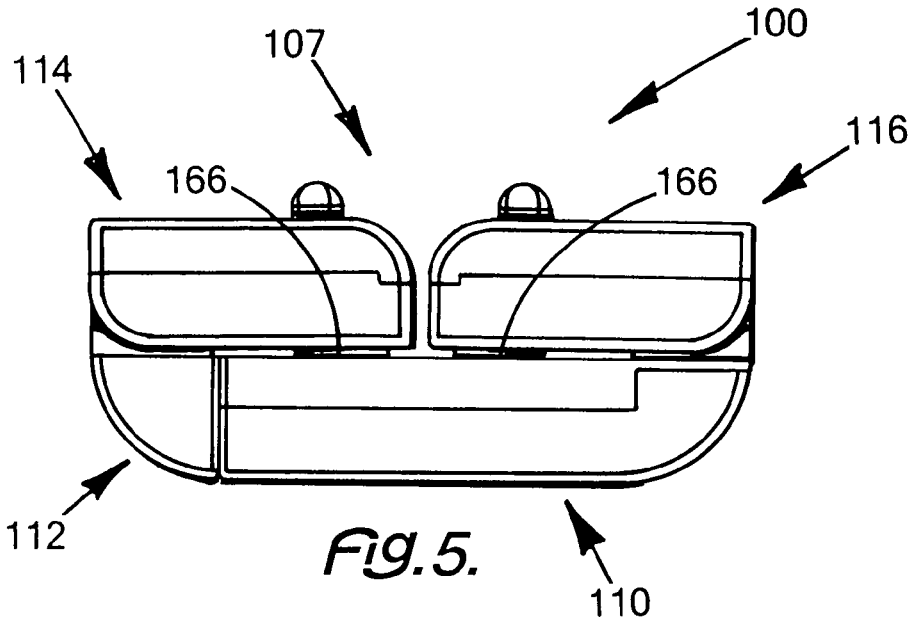
FIG. 5 depicts a top plan view of entry lock 100 in a closed storage position 107.

With left arm assembly 114, the viewing half 160 is seen, while contact half 162 touches door 102 in use or is concealed when entry lock 100 is in closed or closed storage position 107 (FIG. 5). Hinge pin 164 is therebetween. Contact half 162 has gripping pad 166 mounted therein. Gripping pad 166 aids in securing either left arm assembly 114 or right arm assembly 116 in a secure and stable relationship to door 102. The tension between adjustable assembly 112, left arm assembly 114, and right arm assembly 116 secures entry lock 100 in place until a key is inserted into key slot 132 which activates release lever 130. Viewing half 160 preferably has LED light 120 therein. A plurality of threaded inserts 140 and corresponding fastener screws 142 secure viewing half 160 to contact half 162.

With right arm assembly 116, the structure is very similar to left arm assembly 114. But a second hinge pin 164 passes through left hinge 154. There is also cooperation with adjustment assembly 112. Here also, a plurality of threaded inserts 140 and corresponding fastener screws 142 secure viewing half 160 to contact half 162. Viewing half 160 also has LED light 120 therein.

Adding FIG. 5 to the consideration entry lock 100 has closed storage position 107 with all assemblies closed in. More particularly, in closed storage position 107, latch body assembly 110 has adjustable assembly 112, left arm assembly 114 and right arm assembly 116 closely adjacent, and releasably secured thereto. Two of LED (light-emitting diode) 120 are visible thereon, with gripping pads 166 barely visible.

Figure 6:
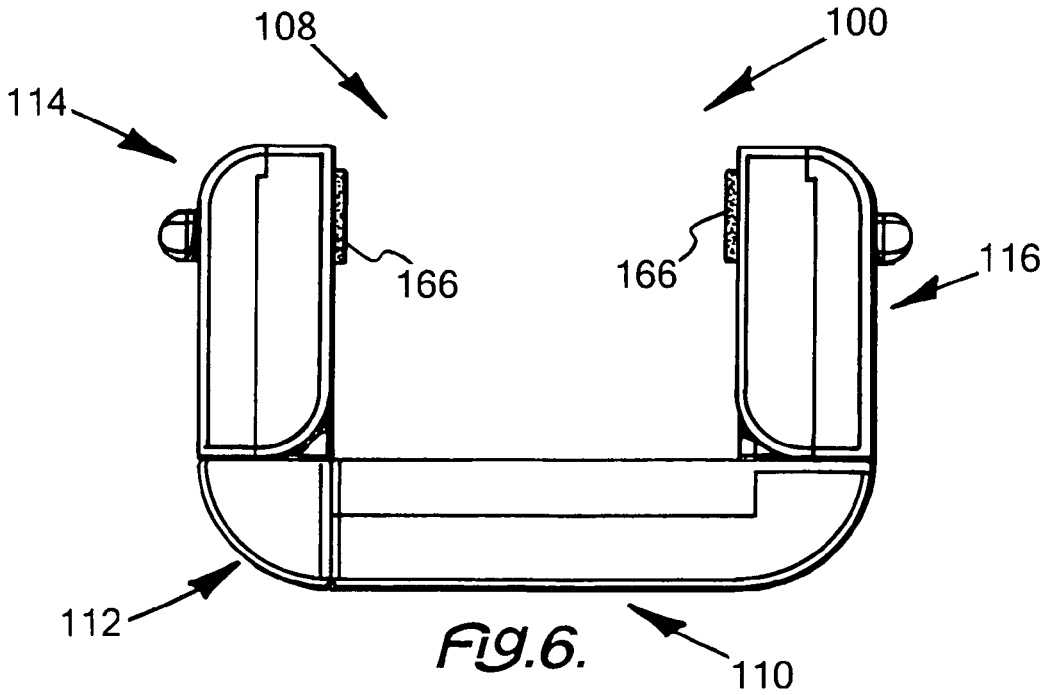
FIG. 6 depicts a top plan view of entry lock 100 with right arm assembly 116 and left arm assembly 114 in an open position 108.

Turning now to FIG. 6 to the consideration entry lock 100 has open position 108 with all assemblies extended outward. More particularly, in open position, latch body assembly 110 has adjustable assembly 112 open, with left arm assembly 114 and right arm assembly 116 substantially parallel. Two of LED (light-emitting diode) 120 are visible thereon, with gripping pads 166 clearly visible.

Figure 7:
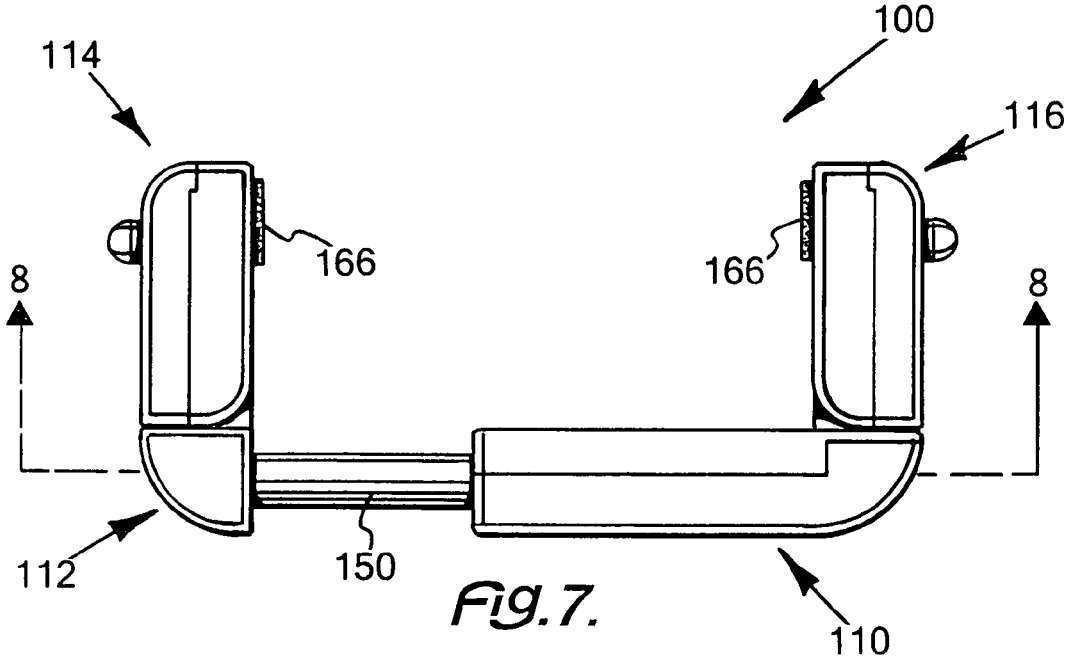
FIG. 7 depicts a top plan view of entry lock 100 with right arm assembly 116 and left arm assembly 114 in an open position 108.
Figure 8:
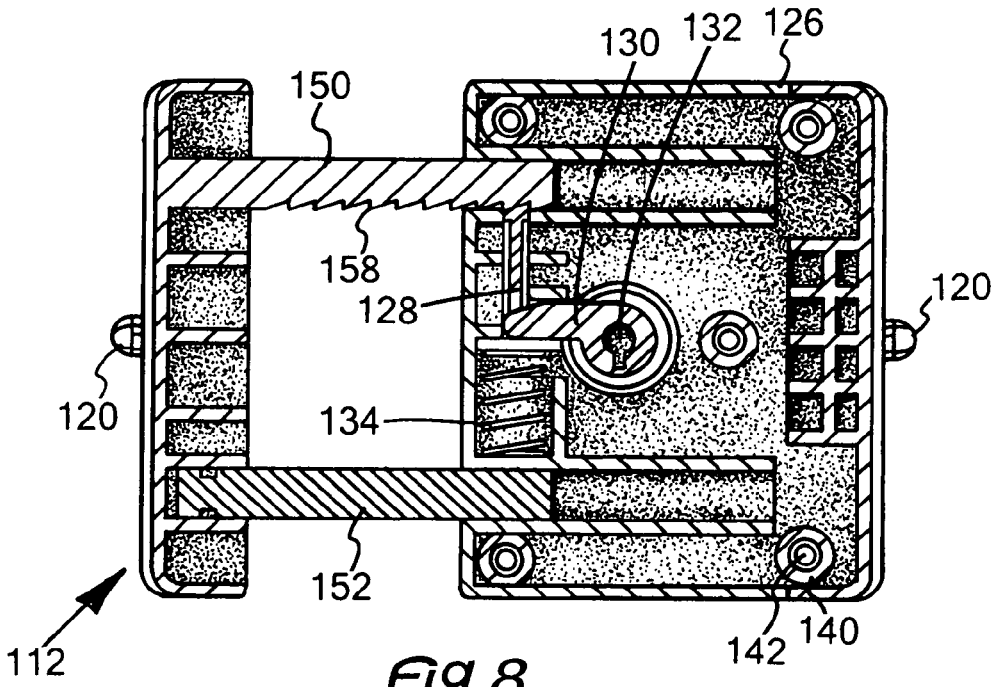
FIG. 8 depicts a cross-sectioned view of entry lock 100 showing latch mechanism 128.

While FIG. 7 and FIG. 8 are similar to FIG. 6, with adjustable assembly 112 being open, leaves latch rack 150 (FIG. 7) or guide pin 152 become (FIG. 8) exposed or visible. Latch teeth 158 and latch 128 (FIG. 4) combine to make entry lock 100 adjustable to a width of door 102 (FIG. 1). With all assemblies in an open position 108, entry lock 100 may then be fitted onto a door 102

Figure 9:
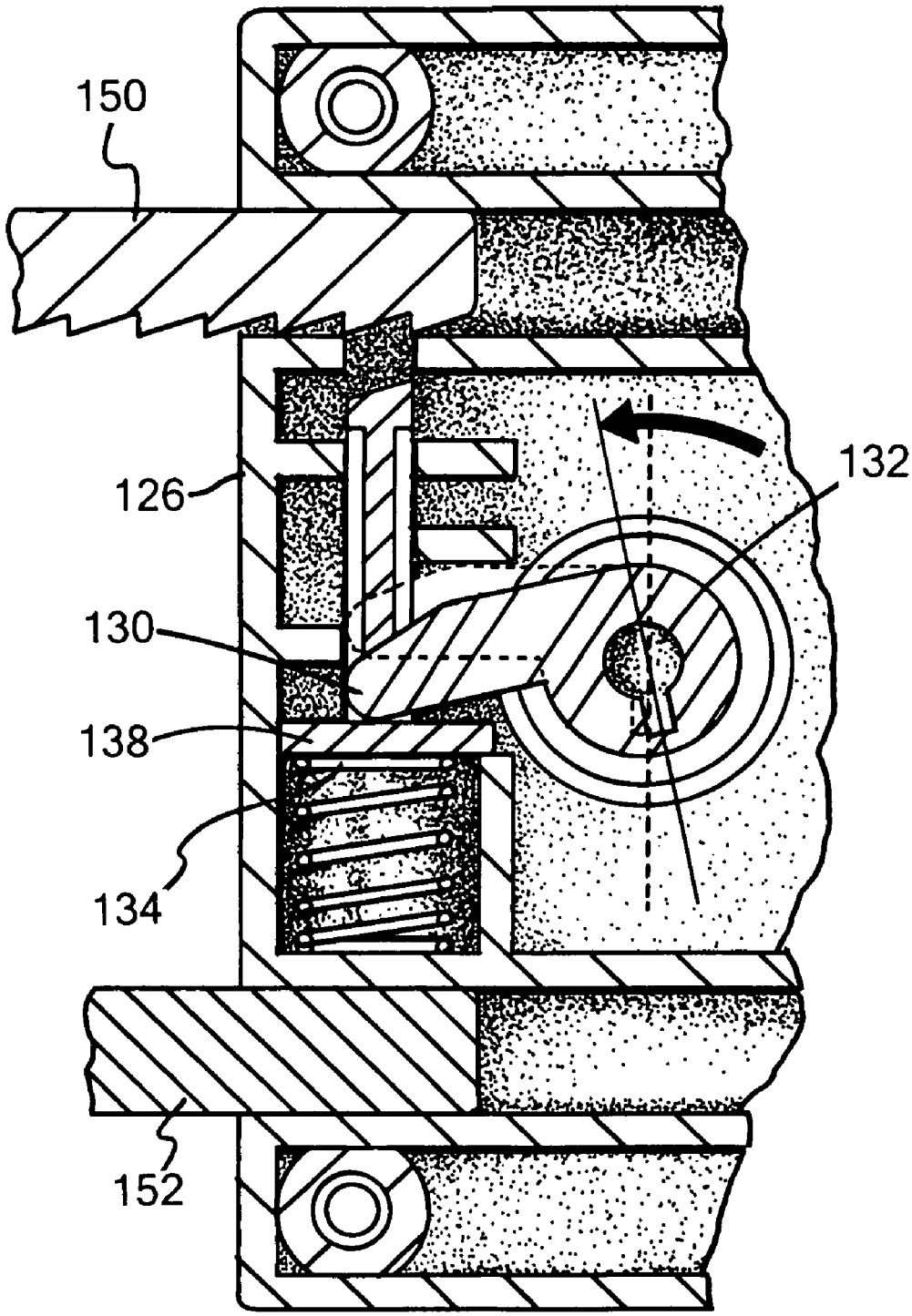
FIG. 9 depicts a close up, cross-sectioned view feature of entry lock 100.

FIG. 8 combines with FIG. 9 to teach the workings of entry lock 100. Back end half 126 supports latch rack 150, which has latch teeth 158, on latch 128. Latch 128 is supported on and above release lever 130. Below release lever 130 is latch spring 134. Latch 128 and latch teeth 158 act like a pawl and ratchet mechanism holding latch rack 150 and hence guide pin 152 in position until a key (not shown) fits into key slot 132 to release latch 128 from latch teeth 158 (FIG. 9), and permit removal of entry lack 100 from door 102 (FIG. 1).

More particularly, a feature of entry lock 100 shows release lever 130 pushing down on latch base 138, thereby lowering latch 128 to disengage from latch rack 150. This action releases adjustable assembly 112 from latch body assembly 110 enabling device 100 to be installed (secured to door 102) or uninstalled (removed from door 102).

This application—taken as a whole with the abstract, specification, claims, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this tool can become clear to a person having ordinary skill in this particular art. Such modifications are clearly covered by this disclosure.

What is claimed and sought to be protected by Letters Patent is:

1. An entry lock being releasably securable to a door comprising:
a) the entry lock having a latch body assembly with a left arm assembly mounted on a first side of the latch body assembly and a right arm assembly supported on a second side of the latch body assembly;
b) an adjustable assembly being connected between the latch body assembly and the left arm assembly in order to provide cooperation between the left arm assembly and the latch body assembly;
c) the left arm assembly and the right arm assembly being mounted on opposing sides of the latch body assembly;
d) the left arm assembly and the right arm assembly being closable on the latch body assembly; and
e) the left arm assembly and the right arm assembly being openable and closable relative to the latch body assembly.

2. The entry lock of claim 1 further comprising:
a) the entry lock including a locking mechanism for releasing or securing the entry lock in a desired position;
b) the adjustable assembly being connected between the latch body assembly and the left arm assembly to provide cooperation therebetween;
c) the latch body assembly including a key slot to receive a key on an outer side thereof; and
d) the latch body assembly including a lock assembly.

3. The entry lock of claim 2 further comprising:
a) the locking mechanism receiving a key through the key slot;
b) the latch body assembly having a front end half and a back end half;
c) a latch being positioned between the front end half and the back end half;
d) a release lever being positioned above the latch to cooperate therewith; and
e) a latch spring supporting the latch and cooperating with the key slot in order to secure or use the entry lock.

4. The entry lock of claim 3 further comprising:
a) a hinge truss being positioned on the front end half to cooperate with a right hinge and receive a hinge pin;
b) a plurality of threaded inserts and corresponding fastener screws securing the front end half to the back end half;
c) the adjustable assembly fitting into the latch body assembly at a first receiver and a second receiver;
d) the adjustable assembly including a latch rack and a guide;
e) the first receiver holding the latch rack; and
f) the second receiver holding the guide.

5. The entry lock of claim 4 further comprising:
a) the adjustable assembly having a left hinge positioned between the latch rack and the guide pin;
b) the latch rack including latch teeth to facilitate adjustment of the entry lock;
c) the left arm assembly and the right arm assembly having a viewing half to be seen when the entry lock is in use and an oppositely disposed contact half, the contact half being concealed by the door either when the entry lock is in use or when the entry lock is in a closed or a storage position;
d) a hinge pin being between the contact half and the viewing half; and
e) the contact half including a gripping pad.

6. The entry lock of claim 5 further comprising:
a) the entry lock being assembled with the plurality of threaded inserts and corresponding fastener screws;
b) the right arm assembly being similar to the left arm assembly;
c) a second hinge pin passing through the left hinge; and
d) the viewing half including a light means.

7. The entry lock of claim 6 further comprising:
a) the light means being a light emitting diode;
b) the entry lock having a closed storage position;
c) the entry lock having a open position for use;
d) the back end half supporting the latch teeth; and
e) the latch and the latch teeth acting as a pawl and ratchet to position the latch rack as desired.

8. The entry lock of claim 7 further comprising:
a) the release lever being adapted to push down on a latch base which supports the latch to lower the latch and disengage from the latch rack;
b) the entry lock being securable to opposing sides of the door while the latch body assembly is locked or secured to an edge of the door; and
c) the entry lock being operable with a handcuff key.

9. An entry lock being releasably securable to a door comprising:
a) the entry lock having a latch body assembly with a left arm assembly and a right arm assembly;
b) an adjustable assembly being connected between the latch body assembly and the left arm assembly;
c) the left arm assembly and the right arm assembly being mounted on opposing sides of the latch body assembly;
d) the left arm assembly and the right arm assembly being closable on the latch body assembly;
e) the entry lock having an identification marker thereon; and
f) the left arm assembly and the right arm assembly being closable on the latch body assembly.

10. The entry lock of claim 9 further comprising:
a) the entry lock including a locking mechanism for releasing or securing the entry in a desired position;
b) the adjustable assembly being connected between the latch body assembly and the left arm assembly;
c) the latch body assembly including a key slot to receive a key on an outer side thereof; and
d) the latch body assembly including a lock assembly.

11. The entry lock of claim 10 further comprising:
a) the locking mechanism receiving a key through the key slot;
b) the latch body assembly having a front end half and a back end half;

c) a latch being positioned between the front end half and the back end half;
d) a release lever being positioned above the latch to cooperate therewith; and
e) a latch spring supporting the latch and cooperating with the key slot in order to secure or use the entry lock.

12. The entry lock of claim 11 further comprising:
a) a hinge truss being positioned on the front end half to cooperate with a right hinge and receive a hinge pin;
b) a plurality of threaded inserts and corresponding fastener screws securing the front end half to the back end half;
c) the adjustable assembly fitting into the latch body assembly at a first receiver and a second receiver;
d) the adjustable assembly including a latch rack and a guide;
e) the first receiver holding the latch rack; and
f) the second receiver holding the guide.

13. The entry lock of claim 12 further comprising:
a) the adjustable assembly having a left hinge positioned between the latch rack and the guide pin;
b) the latch rack including latch teeth to facilitate adjustment of the entry lock;
c) the left arm assembly and the right arm assembly have a viewing half to be seen when the entry lock is in use and an oppositely disposed contact half, the contact half being concealed by the door either when the entry lock is in use or when the entry lock is in a closed or a storage position;
d) a hinge pin being between the contact half and the viewing half; and
e) the contact half including a gripping pad.

14. The entry lock of claim 13 further comprising:
a) the entry lock being assembled with the plurality of threaded inserts and corresponding fastener screws;
b) the right arm assembly being similar to the left arm assembly;
c) a second hinge pin passing through the left hinge; and
d) the viewing half including a light means.

15. The entry lock of claim 14 further comprising:
a) the light means being a light emitting diode;
b) the entry lock having a closed storage position;
c) the entry lock having a open position for use;
d) the back end half supporting the latch teeth;
e) the latch and the latch teeth acting as a pawl and ratchet to position the latch rack as desired.

16. The entry lock of claim 15 further comprising:
a) the release lever being adapted to push down on a latch base supporting the latch to lower the latch and disengage from the latch rack;
b) the entry lock being securable to opposing sides of the door while the latch body assembly is locked or secured to an edge of the door; and
c) the lock being operably by a handcuff key.

17. A method of using an entry lock, which is releasably securable to a door comprising:
a) providing the entry lock with a latch body assembly with a left arm assembly and an right arm assembly;
b) providing an adjustable assembly for the entry lock between the latch body assembly and the left arm assembly;
c) having the left arm assembly and the right arm assembly mounted on opposing sides of the latch body assembly;
d) permitting the left arm assembly and the right arm assembly to be closable on the latch body assembly; and
e) permitting the left arm assembly and the right arm assembly being openable on the latch body assembly.

18. The method of claim 17 further comprising:
a) the entry lock including a locking mechanism for releasing or securing the entry in a desired position;
b) the adjustable assembly being connected between the latch body assembly and the left arm assembly;
c) the latch body assembly including a key slot to receive a key on an outer side thereof;
d) the latch body assembly including a lock assembly;
e) the locking mechanism receiving a key through the key slot;
f) the latch body assembly having a front end half and a back end half;
g) a latch being positioned between the front end half and the back end half;
h) a release lever being positioned above the latch to cooperate therewith;
i) a latch spring supporting the latch and cooperating with the key slot in order to secure or use the entry lock;
j) a hinge truss being positioned on the front end half to cooperate with a right hinge and receive a hinge pin; and
k) a plurality of threaded inserts and corresponding fastener screws securing the front end half to the back end half.

19. The method of claim 18 further comprising:
a) the adjustable assembly fitting into the latch body assembly at a first receiver and a second receiver;
b) the adjustable assembly including a latch rack and a guide;
c) the first receiver holding the latch rack;
d) the second receiver holding the guide;
e) the adjustable assembly having a left hinge positioned between the latch rack and the guide pin;
f) the latch rack including latch teeth to facilitate adjustment of the entry lock;
g) the left arm assembly and the right arm assembly having a viewing half to be seen when the entry lock is in use and an oppositely disposed contact half, the contact half being concealed by the door either when the entry lock is in use or when the entry lock is in a closed or a storage position;
h) a hinge pin being between the contact half and the viewing half;
i) the contact half including a gripping pad;
j) the entry lock being assembled with the plurality of threaded inserts and corresponding fastener screws;
k) the right arm assembly being similar to the left arm assembly;
l) a second hinge pin passing through the left hinge; and
m) the viewing half including a light means.

20. The method of claim 19 further comprising:
a) the light means being a light emitting diode;
b) the entry lock having a closed storage position;
c) the entry lock having a open position for use;
d) the back end half supporting the latch teeth;
e) the latch and the latch teeth acting as a pawl and ratchet to position latch rack as desired;
f) the release lever being adapted to push down on latch base supporting the latch to low the latch and disengage from the latch rack;
g) the entry lock being securable to opposing sides of the door while the latch body assembly is locked or secured to an edge of the door; and
h) the lock being operable by a handcuff key.

* * * * *